US011401679B2

(12) United States Patent
Matys

(10) Patent No.: US 11,401,679 B2
(45) Date of Patent: Aug. 2, 2022

(54) COMBINATION STANDARD AND CORNER SEGMENTAL RETAINING WALL BLOCK WITH INTEGRAL VERTICAL INTERLOCK SYSTEM

(71) Applicant: Risi Stone Inc., Newmarket (CA)

(72) Inventor: Tyler Matys, Newmarket (CA)

(73) Assignee: Risi Stone Inc., Newmarket (CA)

( * ) Notice: Subject to any disclaimer, the term of this patent is extended or adjusted under 35 U.S.C. 154(b) by 0 days.

(21) Appl. No.: 17/062,038

(22) Filed: Oct. 2, 2020

(65) Prior Publication Data

US 2021/0108390 A1 Apr. 15, 2021

Related U.S. Application Data

(60) Provisional application No. 62/913,791, filed on Oct. 11, 2019.

(51) Int. Cl.
*E02D 29/02* (2006.01)

(52) U.S. Cl.
CPC ..... *E02D 29/0266* (2013.01); *E02D 29/025* (2013.01)

(58) Field of Classification Search
CPC . E02D 29/0266; E02D 29/025; B28B 7/0079; E04B 2002/0215
See application file for complete search history.

(56) References Cited

U.S. PATENT DOCUMENTS

2001/0019684 A1* 9/2001 Manthei ..... E02D 29/025 405/284
2009/0301028 A1* 12/2009 Pfoff ..... B28B 7/0079 52/741.11
2011/0192097 A1* 8/2011 Kelley, Jr. ..... E04C 1/395 52/166
2016/0369472 A1* 12/2016 Ianello ..... B28B 7/0044

* cited by examiner

*Primary Examiner* — Carib A Oquendo
(74) *Attorney, Agent, or Firm* — Dickinson Wright LLP; Matthew D. Powell

(57) ABSTRACT

A retaining wall block includes a block body having: a top and a bottom spaced from the top by a height H; a front and a rear spaced from the front by a depth D; and a first side and a second side spaced from the first side by a length L; a vertical interlock system comprising: a female component comprising a groove in the bottom of the block body, the groove being spaced from the front by a depth FB and having a depth G, the groove extending from a distance F from the first side through to the second side, wherein F<FB and FB+G<D; and a male component extending across the top of the block body between the first side and the second side, the male component being spaced from the front by at least a depth of FB and having a depth no greater than G, wherein a plurality of gaps in the male component comprise: a first gap extending from the first side and having a first gap length of at least FB; a second gap spaced from the first gap by no more than G and having a second gap length of at least D−FB−G+F, the second gap extending at least to D+F from the first side; a third gap spaced from the second gap and having a third gap length of at least 2F; and a fourth gap (Continued)

spaced from the third gap and having a fourth gap length of at least 2F, the fourth gap extending at least to L−D+F from the first side wherein the fourth gap does not extend all the way to the second side. Various embodiments are described.

20 Claims, 12 Drawing Sheets

COMBINATION STANDARD AND CORNER SEGMENTAL RETAINING WALL BLOCK WITH INTEGRAL VERTICAL INTERLOCK SYSTEM

CROSS-REFERENCE TO RELATED APPLICATION

This application claims priority to U.S. Provisional Patent Application Ser. No. 62/913,791 filed on Oct. 11, 2019, and to Canadian Patent Application No. 3,080,569 filed on May 8, 2020, the contents of which are incorporated herein by reference.

FIELD OF THE INVENTION

The present disclosure relates generally to prefabricated interlocking concrete blocks, and more particularly to combination standard and corner segmental retaining wall blocks, and methods of forming retaining walls with same.

BACKGROUND OF THE INVENTION

Interlocking concrete blocks are used for many outdoor construction applications, one of the most common being the construction of retaining walls. Interlocking concrete blocks are thus designed for durability, stability, and aesthetic appeal.

One of the main benefits of segmental retaining walls (SRW), as compared to more rigid reinforced concrete walls, is the ability to be constructed in complex geometries, such as curves, inside and outside corners, and free-standing two-sided walls such as seat walls. To properly construct an outside 90-degree corner, the SRW must be finished on two faces: 1) the front face of the block, and 2) the exposed corner side (90-degree face) of the block. The current practice is that the standard block is finished only on the front and/or back, and a special corner block is manufactured to be finished on the two exposed sides.

From a manufacturing point of view, the requirement for a specialized corner block is costly and creates logistic issues for production, inventory, sales, and distribution. The specialized corner block is produced with an expensive dry-cast concrete mold, the cost of which is about the same as a standard block mold.

For production, the manufacturer must switch the standard block mold out of the board machine (the dry-cast machine used to produce the blocks), which can be a labor intensive and time-consuming operation, then install the corner block mold. As the number of corner blocks required on a project is typically much less than the number of standard blocks, the production run of corner blocks is often substantially less, which makes the process of switching the molds relatively inefficient.

The specialized corner block must be inventoried and tracked as a separate item in the manufacturers storage yard. In most cases, a dealer or distributor, such as a landscape supply center, also must inventory and track this separate corner block, even through it represents a very small portion of their total wall sales.

From the contractor/installers point of view, specialized units, such as corner blocks, make it more difficult to estimate the required quantities on a project. Typically, wall projects are quoted in total square feet or square meters of wall. The contractor must determine the locations of all corners, the wall heights of those locations, and calculate the individual number of corner blocks required on a project.

Once the material is delivered to the site, the contractor must inventory and track the different units during construction. Experience has shown that contractors will often estimate the number of corner blocks they require very closely, as these can be relatively expensive units (due to the inefficiencies of the manufacturer running small quantities as discussed above). As such, if the estimate is slightly off, or if a few corner blocks are damaged during construction, the contractor cannot continue construction because they are short a few key corner blocks.

In all cases described above, the requirement for a specialized corner block, which is a small but important component of current wall construction, can cause additional expenses, logistics, and potential delays at various points in the supply chain.

SUMMARY OF THE INVENTION

It is an object of an aspect of this description to provide a retaining wall block that can be used interchangeably as a corner block or a standard block.

In accordance with an aspect, there is provided a retaining wall block comprising a block body having: a top and a bottom spaced from the top by a height H; a front and a rear spaced from the front by a depth D; and a first side and a second side spaced from the first side by a length L; a vertical interlock system comprising: a female component comprising a groove in the bottom of the block body, the groove being spaced from the front by a depth FB and having a depth G, the groove extending from a distance F from the first side through to the second side, wherein $F<FB$ and $FB+G<D$; and a male component extending across the top of the block body between the first side and the second side, the male component being spaced from the front by at least a depth of FB and having a depth no greater than G, wherein a plurality of gaps in the male component comprise: a first gap extending from the first side and having a first gap length of at least FB; a second gap spaced from the first gap by no more than G and having a second gap length of at least $D-FB-G+F$, the second gap extending at least to $D+F$ from the first side; a third gap spaced from the second gap and having a third gap length of at least 2F; and a fourth gap spaced from the third gap and having a fourth gap length of at least 2F, the fourth gap extending at least to $L-D+F$ from the first side wherein the fourth gap does not extend all the way to the second side.

In an aspect, the male component is spaced from the front by a depth of FB; and the first gap length is FB.

In an aspect, the male component is spaced from the front by a depth of FB+J, wherein J is a batter offset; and the first gap length is FB+J.

In an aspect, the second gap is spaced from the first gap by distance G.

In an aspect, the second gap is spaced from the first gap by less than G.

In an aspect, the retaining wall block further comprises: a fifth gap spaced from the fourth gap and extending all the way to the second side.

In an aspect, the second gap length is at least $D-FB-G+WC$; the third gap length is at least 2 WC; and the fourth gap length is at least 2 WC, wherein $WC=F+T$ and T is a tolerance.

In an aspect, the third gap is centred at L/2 along the block.

In an aspect, each of the groove and the male component is bevelled.

According to another aspect, a set of retaining wall blocks comprises: a first plurality of retaining wall blocks, wherein the first side is the left side; and a second plurality of retaining wall blocks, wherein the first side is the right side.

According to another aspect, there is provided a retaining wall block comprising a block body having: a top and a bottom spaced from the top by a height H; a front and a rear spaced from the front by a depth D; and a first side and a second side spaced from the first side by a length L; a vertical interlock system comprising: a female component comprising a groove in the bottom of the block body, the groove being spaced from the front by a depth FB and having a depth G, the groove extending from a distance F from the first side through to the second side, wherein F<FB and FB+G<D; and a male component extending across the top of the block body between the first side and the second side, the male component being spaced from the front by at least a depth of FB and having a depth no greater than G, wherein a plurality of gaps in the male component comprise: a first gap extending from the first side and having a first gap length of at least FB; a second gap spaced from the first gap by no more than G and having a second gap length of at least D−FB−G+F, the second gap extending at least to D+F from the first side; a third gap spaced from the third gap and extending from at least D+F from the second side and having a third gap length of at least 2F, wherein the third gap does not extend all the way to the second side.

In an aspect, the male component is spaced from the front by a depth of FB; and the first gap length is FB.

In an aspect, the male component is spaced from the front by a depth of FB+J, wherein J is a batter offset; and the first gap length is FB+J.

In an aspect, the first male key length is G.

In an aspect, the first male key length is less than G.

In an aspect, the fourth male key does not extend all the way to the second side.

In an aspect, the second gap length is at least D−FB−G+WC; the third gap length is at least 2 WC; and the fourth gap length is at least 2 WC, wherein WC=F+T and T is a tolerance.

In an aspect, the third gap is centred at L/2 along the block.

In an aspect, each of the groove and the male component is bevelled.

According to another aspect, there is provided a set of retaining wall blocks comprising: a first plurality of retaining wall blocks wherein the first side is the left side; and a second plurality of retaining wall blocks wherein the first side is the right side.

According to another aspect, there is provided a retaining wall block comprising: a block body having: a top and a bottom spaced from the top by a height H; a front and a rear spaced from the front by a depth D; and a first side and a second side spaced from the first side by a length L; a vertical interlock system comprising: a female component comprising a groove in the bottom of the block body, the groove being spaced from the front by a depth FB and having a depth G, the groove extending from a distance F from the first side through to the second side, wherein F<FB and FB+G<D; and a male component extending across the top of the block body between the first side and the second side, the male component being spaced from the front by at least a depth of FB and having a depth no greater than G, wherein a plurality of gaps in the male component comprise: a first gap extending from the first side and having a first gap length of at least FB; a second gap spaced from the first gap by no more than G and having a second gap length of at least D−FB−G+F, the second gap extending at least to D+F from the first side; a third gap spaced from the third gap and extending from at least D+F from the second side and having a third gap length of at least 2F, wherein the third gap does not extend all the way to the second side.

In an aspect, the male component is spaced from the front by a depth of FB; and the first gap length is FB.

In an aspect, the male component is spaced from the front by a depth of FB+J, wherein J is a batter offset; and the first gap length is FB+J.

In an aspect, the second gap is spaced from the first gap by distance G.

In an aspect, the second gap is spaced from the first gap by less than G.

In an aspect, the retaining wall block comprises a fourth gap spaced from the third gap and extending all the way to the second side.

In an aspect, the second gap length is at least D−FB−G+WC; and the third gap length is at least 2 WC, wherein WC=F+T and T is a tolerance.

In an aspect, each of the groove and the male component is bevelled.

According to an aspect, there is provided a set of retaining wall blocks comprising: a first plurality of retaining wall blocks wherein the first side is the left side; and a second plurality of retaining wall blocks wherein the first side is the right side.

According to another aspect, there is provided a retaining wall block comprising: a block body having: a top and a bottom spaced from the top by a height H; a front and a rear spaced from the front by a depth D; and a first side and a second side spaced from the first side by a length L; a vertical interlock system comprising: a female component comprising a groove in the bottom of the block body, the groove being spaced from the front by a depth FB and having a depth G, the groove extending from a distance F from the first side through to the second side, wherein F<FB and FB+G<D; and a male component extending across the top of the block body between the first side and the second side, the male component being spaced from the front by at least a depth of FB and having a depth no greater than G, wherein the male component comprises: a first male key spaced from the first side by a first gap having a first gap length of at least FB, the first male key having a first male key length of no greater than G; a second male key spaced from the first male key by a second gap having a second gap length of at least D−FB−G+F, the second gap extending at least to D+F from the first side; and a third male key spaced from the second male key by a third gap having a third gap length of at least 2F, the third gap extending from at least D+F from the second side to at least to L−D+F from the first side.

In an aspect, the male component is spaced from the front by a depth of FB; and the first gap length is FB.

In an aspect, the male component is spaced from the front by a depth of FB+J, wherein J is a batter offset; and the first gap length is FB+J.

In an aspect, the first male key length is G.

In an aspect, the first male key length is less than G.

In an aspect, the third male key does not extend all the way to the second side.

In an aspect, the second gap length is at least D−FB−G+WC; and the third gap length is at least 2 WC, wherein WC=F+T and T is a tolerance.

In an aspect, the second male key is centred at L/2 along the block.

In an aspect, each of the groove and the male component is bevelled.

According to another aspect, there is provided a set of retaining wall blocks comprising: a first plurality of retaining wall blocks wherein the first side is the left side; and a second plurality of retaining wall blocks wherein the first side is the right side.

BRIEF DESCRIPTION OF THE FIGURES

Embodiments will now be described more fully with reference to the accompany drawings, in which.

DETAILED DESCRIPTION OF THE EMBODIMENTS

Figure 1:
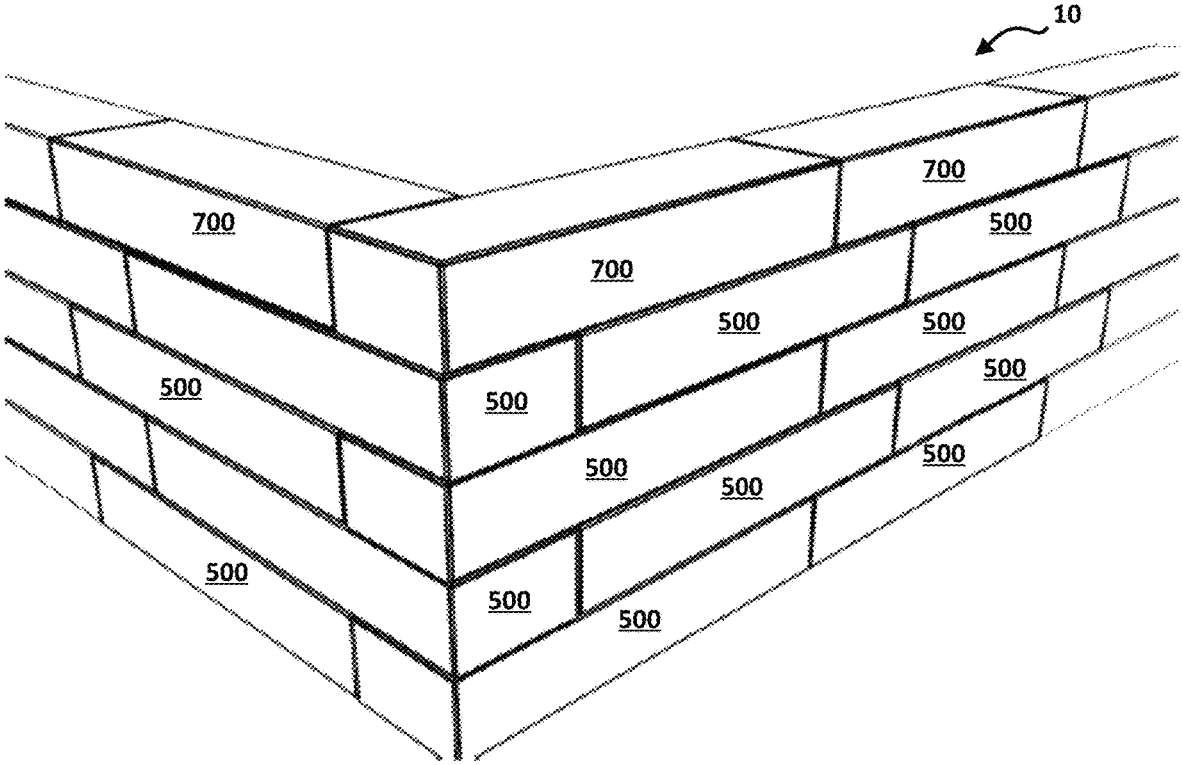
FIG. 1 is a perspective view of a corner portion of a retaining wall having a natural bond pattern made with several retaining wall blocks according to an embodiment.

FIG. 1 is a perspective view of a corner portion of a retaining wall 10 having a natural bond pattern made with several retaining wall blocks 500 and 700, according to an embodiment. In this embodiment, the corner portion is a 90-degree corner. Each of retaining wall blocks 500 is alike, and vertically interlocks with blocks of retaining wall 10 above and (with the exception of the bottommost of the retaining wall blocks 500 in retaining wall 10) below it, as will be described. Retaining wall blocks 700 are each alike, and are similar to retaining wall blocks 500 with the exception that, as coping or finishing blocks, they do not have a vertical interlock system component associated with their top sides.

At the corner portion of retaining wall 10, retaining wall blocks 500 and 700 show finished sides. That is, vertical interlock system components are not visible from those sides of retaining wall blocks 500 and 700 associated with the corner, once the retaining wall 10 is built.

Figure 2:
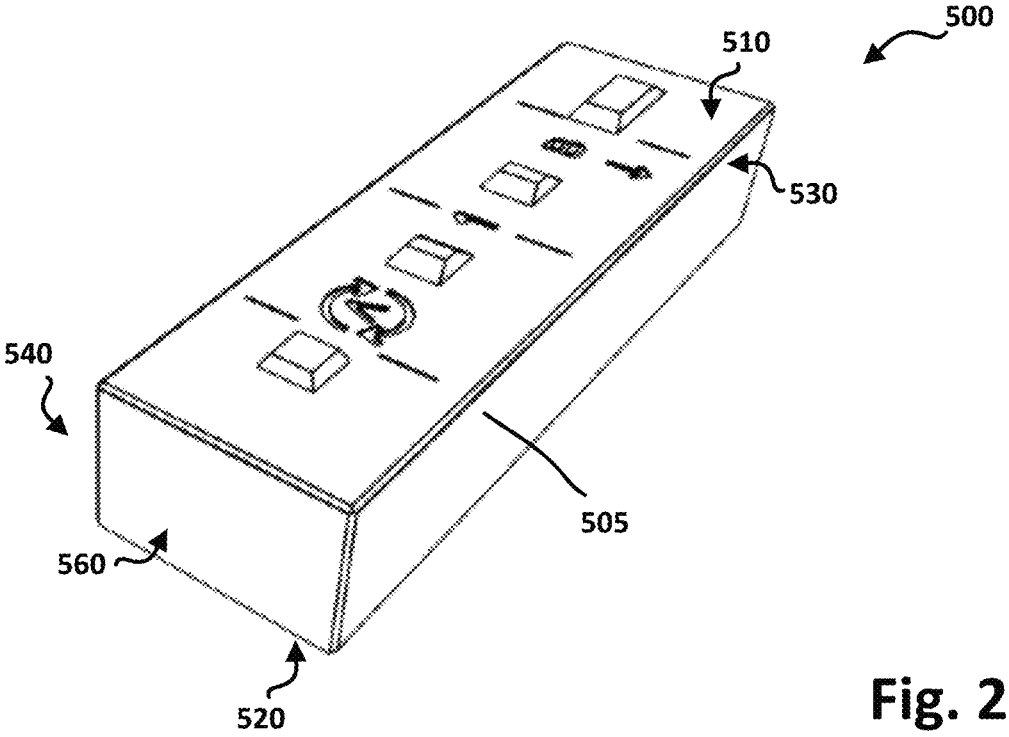
FIG. 2 is a first side perspective view of the retaining wall block of FIG. 2, according to an embodiment.
Figure 3:
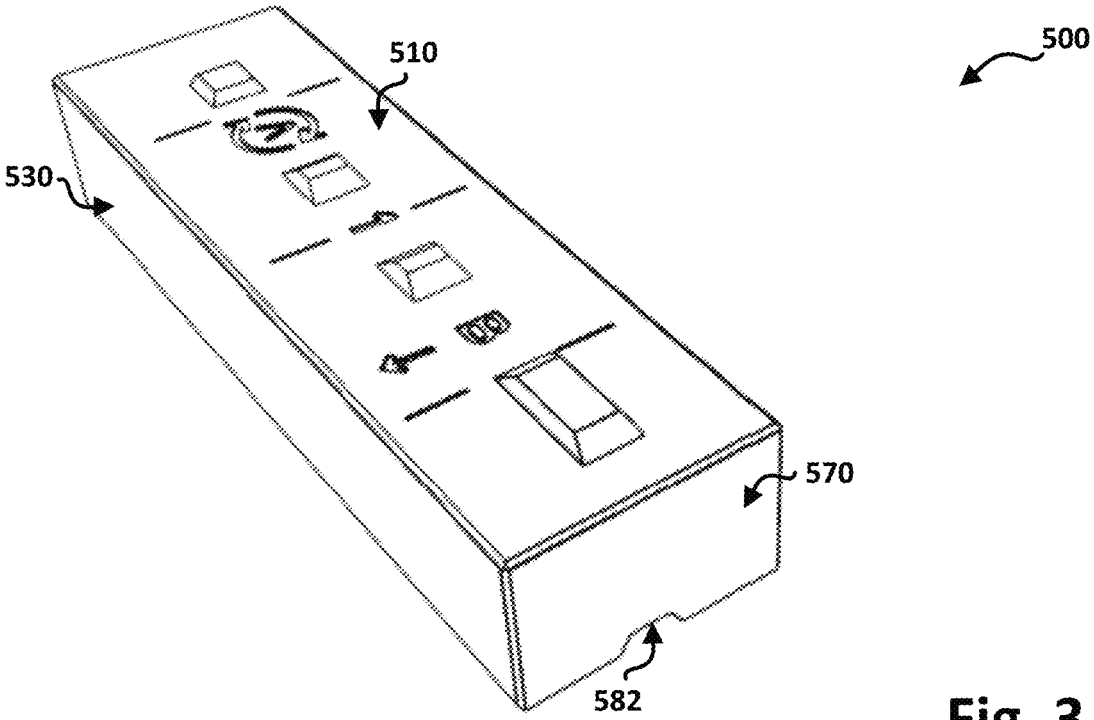
FIG. 3 is a second side perspective view of the retaining wall block of FIG. 2.

FIG. 2 is a first side perspective view of retaining wall block 500, according to an embodiment, and FIG. 3 is a second side perspective view of retaining wall block 500. According to the invention, block 500 has a vertical interlock system and is formed such that it could be successfully installed as part of a retaining wall having a corner with other like blocks, oriented in such a retaining wall the same way as all blocks beneath/above it in a retaining wall, or oriented in the wall at 90 degrees with respect to some blocks beneath or above it in the retaining wall thereby to be part of the corner. The same block 500 therefore could be selected either for the corner portion of the retaining wall, or for a middle portion of the retaining wall. Furthermore, in this embodiment, block 500 is formed such that it could be successfully installed as part of a retaining wall having a natural bond pattern. Block 500 incorporates particular features to allow for this flexibility, as will be described below.

Retaining wall block 500 includes a block body 505 that is generally rectilinear. More particularly, block body 505 includes a top 510 and a bottom 520 opposite the top 510. Top 510 and bottom 520 are spaced from each other by a block height H, as they run generally parallel to each other. Block body also includes a front 530 and a rear 540 opposite the front 530. Front 530 and rear 520 are spaced from each other by a block depth D, as they run generally parallel to each other. Block body also includes a first side 560 and a second side 570 opposite the first side 560. First side 560 and second side 570 are separated from each other by a block length L as they run generally parallel to each other. In the figures of this specification, generally first side 560 is shown on the left, and second side 570 is shown on the right.

In this embodiment, the edges at which top and sides, top and front, top and back, bottom and sides, bottom and front, bottom and back respectively meet are bevelled. This is to avoid breakages of sharp corners and to facilitate their molding using mold components that can be configured and oriented so as to avoid a popcorn effect that might be difficult to avoid were block body 505 to have sharp 90 degree corners.

Retaining wall block 500 also includes a vertical interlock system for enabling retaining wall block 500 to vertically interlock with another like block 500 for constructing a retaining wall with several blocks 500. In this embodiment, the vertical interlock system includes a female component 580 and a male component 590. In this embodiment, each of female component 580 and male component 590 are bevelled thereby to enable interlock but also to avoid breakages of sharp corners and to facilitate their molding using mold components that can be configured and oriented so as to avoid a popcorn effect that might be difficult to avoid were components 580, 590 to have sharp 90 degree corners.

In this embodiment, female component 580 includes a groove 582 in bottom 520, running parallel to front 530 and to top 510. Groove 582 is open to bottom 520 thereby to receive portions of male component 590 from below, as will be described. Groove 582 is spaced from front 530 by a depth FB, and groove 582 itself has a depth G, the depth G being in a front-to-back direction. As such, moving into block body 505 from front 530, groove 582 begins at FB and ends at FB+G. However, groove 582 does not extend all the way through to back 540 of block body 505. That is, FB+G is less than depth D of block body 505.

Groove 582 does not extend through from first side 560 to second side 570. Rather, groove 582 extends from a distance F from the first side through to second side 570. As can be seen in FIG. 3, groove 582 is open to second side 570 but is not open to first side 560, as shown in FIG. 2. This may be thought of as a portion of groove 580 towards first side 560 being "filled". In this way, female component 580 can be provided without interrupting first side 560, thus enabling first side 560 to be part of a finished corner of a retaining wall due to its uninterrupted face. F is less than FB, which permits an upper block 500 to be oriented 90 degrees with respect to a lower adjacent block 500 for a retaining wall corner, without the upper block 500 forming an overhang with respect to the lower block 500. It will be understood that F should be of a sufficient distance to be structurally sound and well-integrated with the rest of block body 505.

In this embodiment, male component 590 extends across top 510 between first side 560 and second side 570, and runs parallel to front 530 and to top 510. In this embodiment, male component 590 is spaced from front 530 by depth FB+J, where J is a batter offset enabling successive courses of blocks 500 to form a batter, rather than to be solely vertical. Male component 590 has a front-to-back depth of no more than G, so that portions of male component 590 can be received within portions of groove 582 of female component 580. Similarly, male component 590 has a height that is slightly less than the corresponding height of groove 582, so that when portions of male component 590 are received within portions of groove 582, the bottom 520 of an upper block 500 contacts the top 510 of a block 500 beneath it.

Moving along top 510 of block body 505 from front 530 to back 540, male component 590 begins at FB+J and ends no further than FB+J+G. However, male component 590 does not extend all the way to be flush with back 540 of block body 505. That is, FB+J+G is less than depth D of block body 505.

While male component 590 extends across top 510 of block body 505, multiple spaced gaps in the male component resulting in multiple male keys of male component 590 that are themselves dimensioned to be received within female components 580 of blocks 500 in a next-higher retaining wall course. As will be described, the multiple male keys are receivable by female component 580 in various orientations and retaining wall formats. Similarly, the multiple spaced gaps in male component 590 are themselves dimensioned to receive the filled portion as blocks 500 are laid atop each other in successive courses in various orientations and retaining wall formats. In this embodiment, interlocking is provided that is reasonably near to each of sides 560, 570 of block 500 thereby to provide somewhat symmetrical interlock across the span of block 500 when part of a retaining wall.

Figure 4:
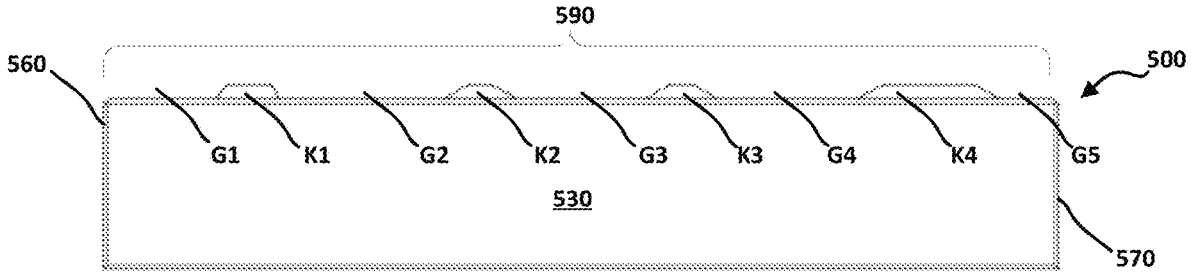
FIG. 4 is a front elevation view of a retaining wall block, according to an embodiment.
Figure 5:
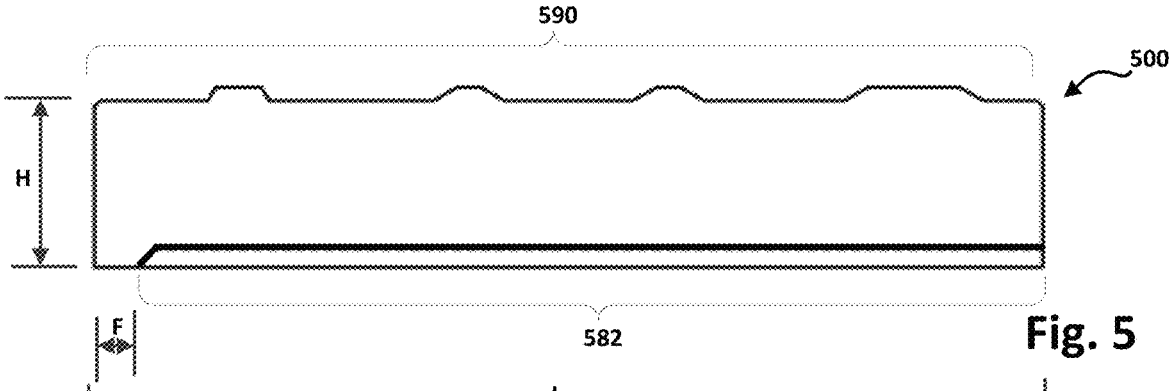
FIG. 5 is a front sectional view of the retaining wall block of FIG. 2.

FIG. 4 is a front elevation view of retaining wall block 500. As shown in FIG. 5, gaps G1, G2, G3, G4 and G5 in male component 590 are spaced from each other thereby to form male keys K1, K2, K3 and K4. An explanation for the particular spacings and key lengths is provided below in terms of potential conflict areas between the filled portion of groove 582 of female component 580 and the underlying male component 590 of a block 500 below it, in various potential configurations and orientations. However, the dimensions of keys K1 to K4 and gaps G1 to G5 for permitting vertical interlock, finished corners, and half-bond wall construction with multiple instances of block 500, while providing interlocking that is reasonably near to each of sides 560, 570 for providing interlock across the span of block 500, is summarized in the following.

In this embodiment, first gap G1 extends from first side 560 towards second side 570 and has a first gap length of at least FB+J. Second gap G2 is spaced from first gap G1 by a non-zero distance that is no more than distance G thereby to provide—between second gap G2 and first gap G1—first male key K1 having a length no greater than G. It will be appreciated that length G corresponds to the (front to back) depth G of groove 582. The non-zero distance between second gap G2 and first gap G1 forming first male key K1 is sufficient for ensuring first male key K1 is structurally well-integrated with block body 505 for providing reliable and durable interlocking with a like block 500 above it in a retaining wall.

Second gap G2 has a second gap length of at least D−FB−G+WC, and it extends at least as far as D+F from first side 560, and in this embodiment extends as far as D+WC from the first side. In this embodiment, WC consists of a desired distance F (or, thickness of the Filled portion) between first side 560 and the leftmost extent of groove 582, plus a small tolerance distance T to be maintained.

A third gap G3 is spaced from second gap G2 by a non-zero distance to provide—between third gap G3 and second gap G2—second male key K2. The non-zero distance between third gap G3 and second gap G2 forming second male key K2 is sufficient for ensuring second male key K2 is structurally well-integrated with block body 505 for providing reliable and durable interlocking with a like block 500 above it in a retaining wall.

Third gap G3 has a third gap length of at least 2 WC. Furthermore, third gap G3 is centred at the halfway point—that is, at L/2—along block body 505.

A fourth gap G4 is spaced from third gap G3 by a non-zero distance to provide—between fourth gap G4 and third gap G3—third male key K3. The non-zero distance between fourth gap G4 and third gap G3 forming third male key K3 is sufficient for ensuring third male key K3 is structurally well-integrated with block body 505 for providing reliable and durable interlocking with a like block 500 above it in a retaining wall.

Fourth gap G4 has a fourth gap length of at least 2 WC, and extends at least as far as L−D+WC from the first side. Fourth gap G4 does not extend all the way to second side 570. Between second side 570 and fourth gap G4 is formed fourth male key K4.

In this embodiment, fifth gap G5 is spaced from fourth gap G3 by a non-zero distance thereby to provide an end to fourth male key K4 that itself is not flush with second side 570. The non-zero distance between fifth gap G5 and fourth gap G4 forming fourth male key K4 is sufficient for ensuring fourth malekey K4 is structurally well-integrated with block body 505 for providing reliable and durable interlocking with a like block 500 above it in a retaining wall.

FIG. 5 is a front sectional view of retaining wall block 500, from a vantage that is roughly halfway between front 530 and back 540 of block body 505. This vantage permits the viewing of groove 582 of female component 580 extending toward second side 570 from a point that is a distance F from first side 560.

Figure 6:
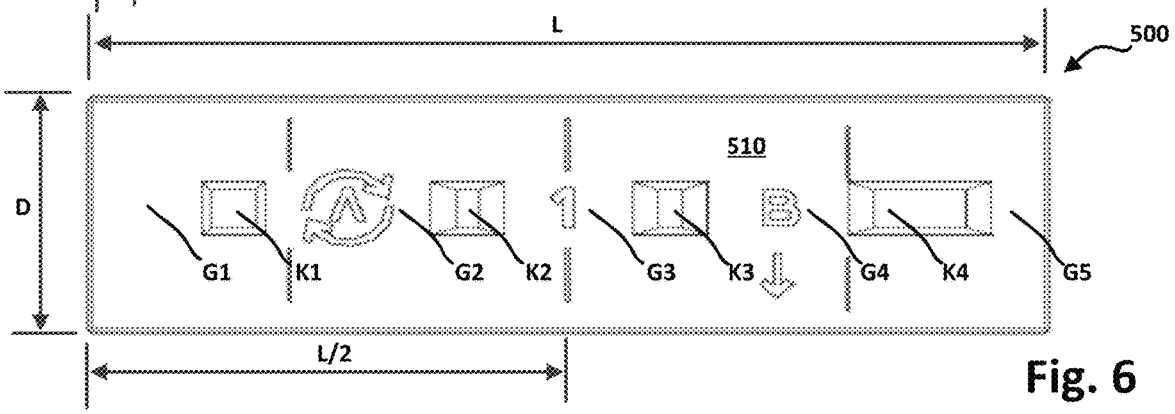
FIG. 6 is a top plan view of the retaining wall block of FIG. 2.
Figure 15:
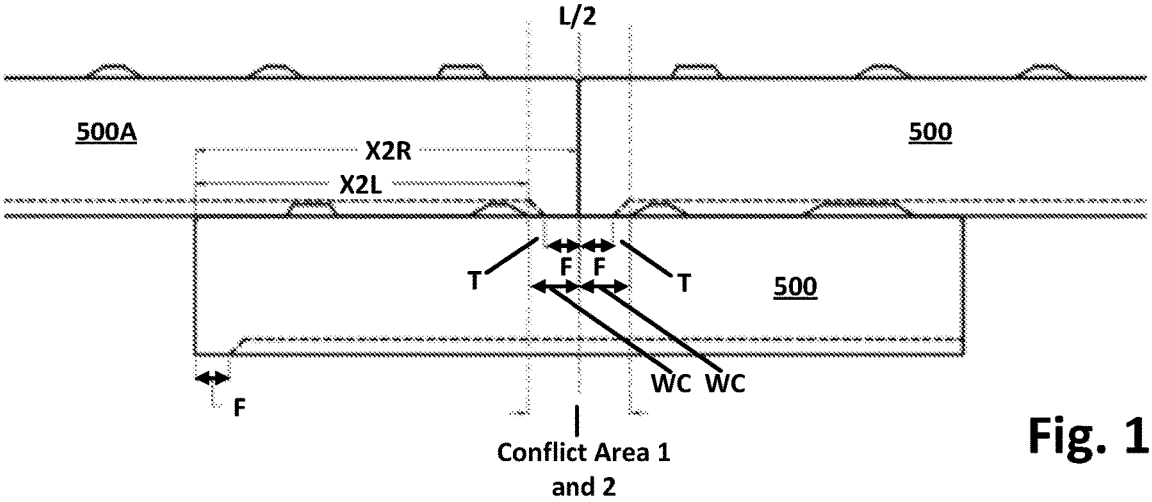
FIG. 15 is a front elevation view of the interaction between three retaining wall blocks according to an embodiment, in two successive courses of a retaining wall having a half bond pattern and showing first and second conflict areas.

FIG. 6 is a top plan view of retaining wall block 500. Markings are molded into top 510 of block body 505 to provide guidance to a person constructing a retaining wall as to alignment for natural or half bond construction, which of front 530 and back 540 should be facing outwards for providing a battered wall or a non-battered wall, and which type of block is being handled. Regarding battering, according to this description block 500 may be placed with front 530 of blocks 500 always facing outwards for battering through successive courses. However, block 500 may be placed with rear 540 facing outwards in every other course, so as to provide a non-battered wall over the courses. The markings on top 510 of block body 505 provide guidance during construction as to the orientation of the block 500 about to be positioned. Regarding which type of block is being handled, it will be appreciated that, for blocks 500 that permit battering, a set of retaining wall blocks for building a full retaining wall may include "left corner" and "right corner" blocks. Retaining wall block 500, in this description, is a left corner block because it is finished for a left corner (when facing the front of a retaining wall), and retaining wall block 500A, for example seen in FIG. 15, is a right corner block because it is finished for a right corner. It will be appreciate that retaining wall blocks 500 and 500A are the same except, whereas in the present description for block 500 the first side is the left side such that filled portion is at its left, for block 500A the the first side is the right side such that the filled portion is at its right. It will be appreciated that, for embodiments that do not permit batter, block 500 may be used interchangeably for left corners or right corners.

Figure 7:
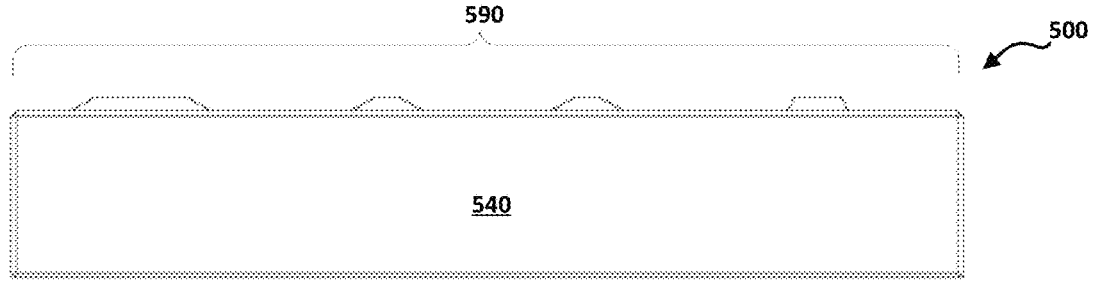
FIG. 7 is a rear elevation view of the retaining wall block of FIG. 2.

FIG. 7 is a rear elevation view of retaining wall block 500. Female component 580 and, in particular, groove 582, cannot be seen from front 530 or from rear 540 of retaining wall block 500.

Figure 8:
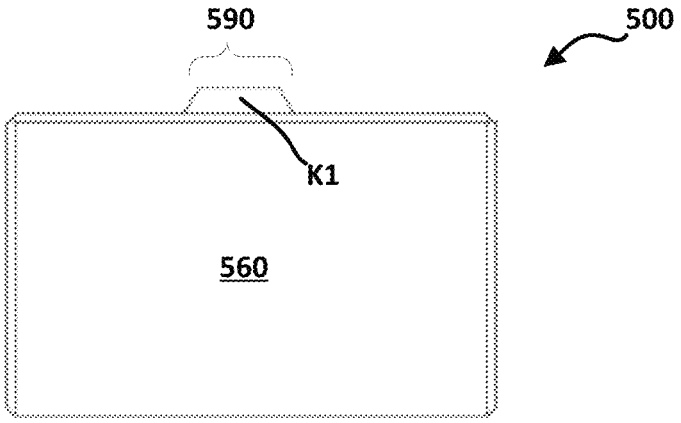
FIG. 8 is a first side view of the retaining wall block of FIG. 2.
Figure 9:
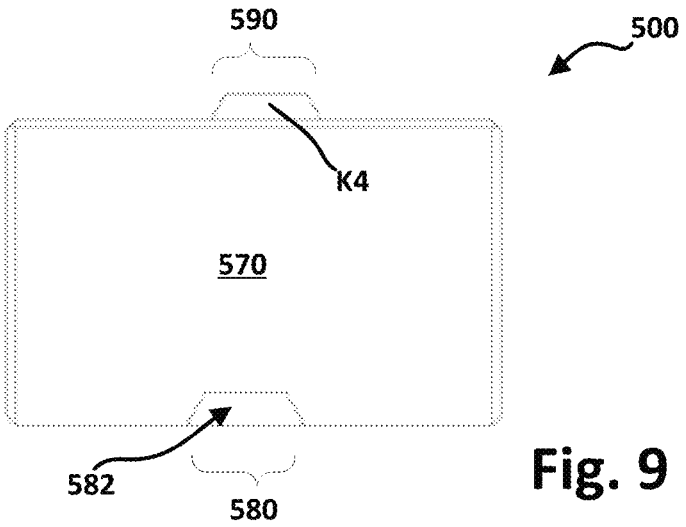
FIG. 9 is a second side view of the retaining wall block of FIG. 2.

FIG. 8 is a first side view of retaining wall block 500, and FIG. 9 is a second side view of retaining wall block 500. Female component 580 and, in particular, groove 582, cannot be seen from first side 560, but can be seen from second side 570. In FIG. 8, first male key K1 can be seen on top 510 of block body 505. In FIG. 9, fourth male key K4 can be seen on top 510 of block body 505. It can also be seen in FIG. 9 that fourth male key K4 (and thus male component 590) begins slightly farther along top 510 from front 530 than does groove 582 along bottom 520, thereby to permit batter through successive courses of blocks 500 in a retaining wall.

Figure 10:
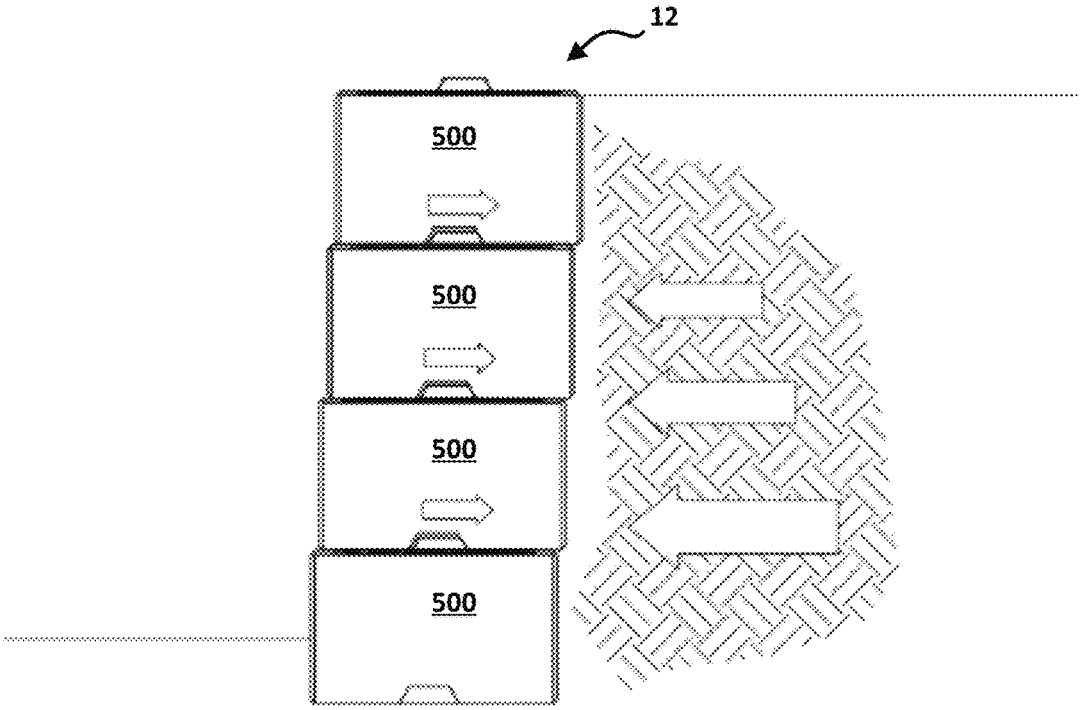
FIG. 10 is a side view of a retaining wall with batter retaining fill.

FIG. 10 is a side view of a retaining wall 12 formed with a batter using successive courses of blocks 500.

Figure 11:
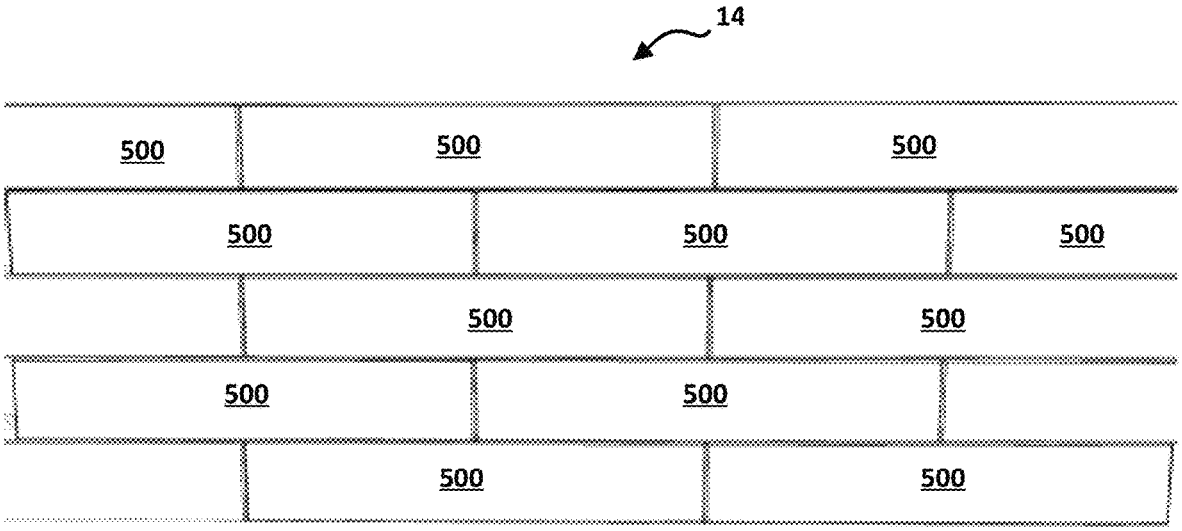
FIG. 11 is a front elevation view of a retaining wall having a half bond pattern made with a plurality of retaining wall blocks.

FIG. 11 is a front elevation view of a retaining wall 14 having a half-bond pattern made with a plurality of retaining wall blocks 500.

Figure 12:
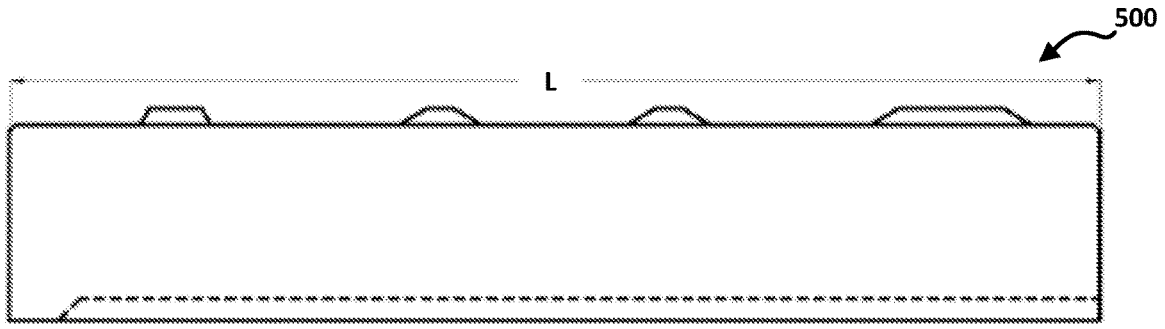
FIG. 12 is a front elevation view of the retaining wall block of FIG. 2, showing a groove of a female component of a vertical interlock interface through the front of the retaining wall block in dashed lines.

FIG. 12 is a front elevation view of the retaining wall block of FIG. 2, showing groove 582 of female component 580 through front 530 of the retaining wall block in dashed lines for reference. Groove 582 is being shown in this and subsequent figures in dashed lines to better illustrate potential conflict areas that can arise when block 500 is stacked course upon course in various orientations and retaining wall configurations. The conflict areas contemplated in this application give rise to the particular lengths of gaps G1 through G5, and corresponding lengths of male keys K1 through K4, described above.

As explained, L is the distance between first side 530 and second side 540, and is thus the length of block 500. In the description below, conflict areas can be described in relation to L. In the following, the variable "X" is the distance along the length of block 500, as measured from first side 530.

Figure 13:
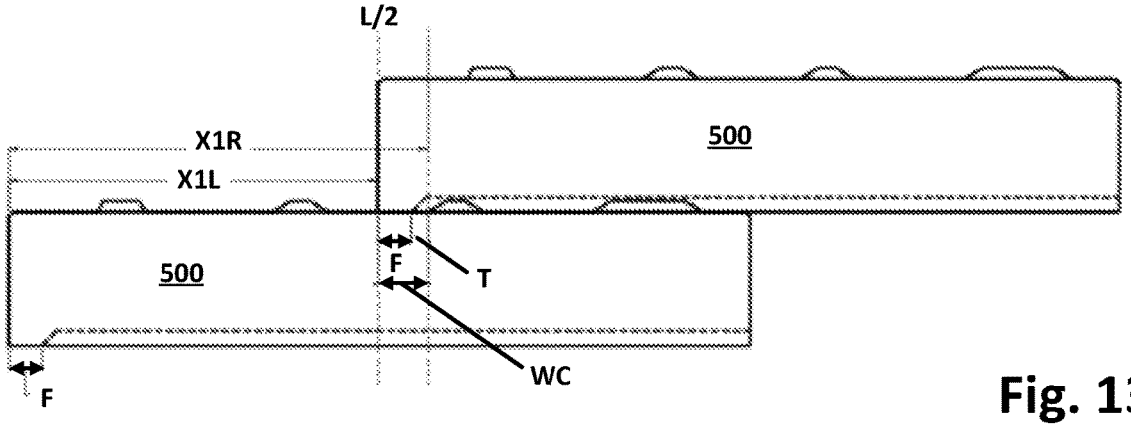
FIG. 13 is a front elevation view of the interaction between two of the retaining wall blocks of FIG. 12 in two successive courses of a retaining wall having a half bond pattern.
Figure 14:
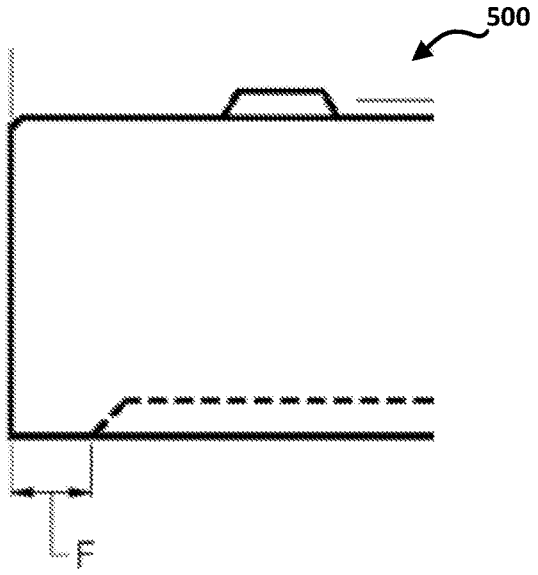
FIG. 14 is an enlarged front elevation view of a first side portion of the retaining wall block of FIG. 12 in isolation.

FIG. 13 is a front elevation view of an interaction between two retaining wall blocks 500 in two successive courses of a retaining wall having a half-bond pattern, and FIG. 14 is an enlarged front elevation view of a first side portion of retaining wall block 500 in isolation.

Returning to FIG. 13, a first conflict area arises when uppermost block 500 is placed atop lowermost block 500 with the 50% overlap. The rightmost extent of the first conflict area is referred-to herein as X1R, and is determined as in Equation 1, below:

$$X1R=0.5\times L+WC(1) \quad (1)$$

As will be appreciated, WC is the left-to-right length of the first conflict area. WC, as described above, is a function of the length F of the "Filled Portion" in groove 582 and Tolerance T to be maintained. That is, WC=F+T. It will be appreciated that Tolerance T can be useful for accommodating for block placement error on either side of the first conflict area.

Furthermore, the left extent X1L of the first conflict area for this half-bond pattern is shown in Equation 2, below:

$$X1L=L/2 \quad (2)$$

As described herein, block 500 is to be usable either as a standard course block and as a corner block. In a typical mold arrangement, the mold would be configured such that half of the blocks in the mold would be for left corners (as in block 500) where the closed end would be on the left side of the block and half would be for right corners (as in block 500A) where the closed end would be on the right side of the block. Were these two variations of blocks to be placed within a retaining wall as standard course blocks, the situation would arise where a left corner block 500 would be placed adjacent to a right corner block 500A. In this case, the "Filled portion" within groove 582 for block 500 would be on the left side of one block and the "Filled portion" within groove 582 for block 500A would be on the right side of one adjacent block. As such, there would be two adjacent "Filled Portions" within the retaining wall. To account for this, a second conflict area is contemplated that is of the same size as the first conflict area, but is located on the opposite side of the center line of block 500. The right extent X2R of this second conflict area is shown in Equation 3, below:

$$X2R=0.5\times L \quad (3)$$

Similarly, the left extent X2L of the second conflict area is shown in Equation 4, below:

$$X2L=X2R-WC \quad (4)$$

FIG. 15 is a front elevation view of the interaction between three retaining wall blocks 500A (one), and 500 (two) according to an embodiment, in two successive courses of a retaining wall having a half bond pattern. The adjacent first and second conflict areas are shown.

A natural bond pattern is created when a block 500 is oriented at 90 degrees at a corner with respect to a block 500 below it in the retaining wall. The offset for such a natural bond pattern thus corresponds to the depth D of block 500.

Figure 16:
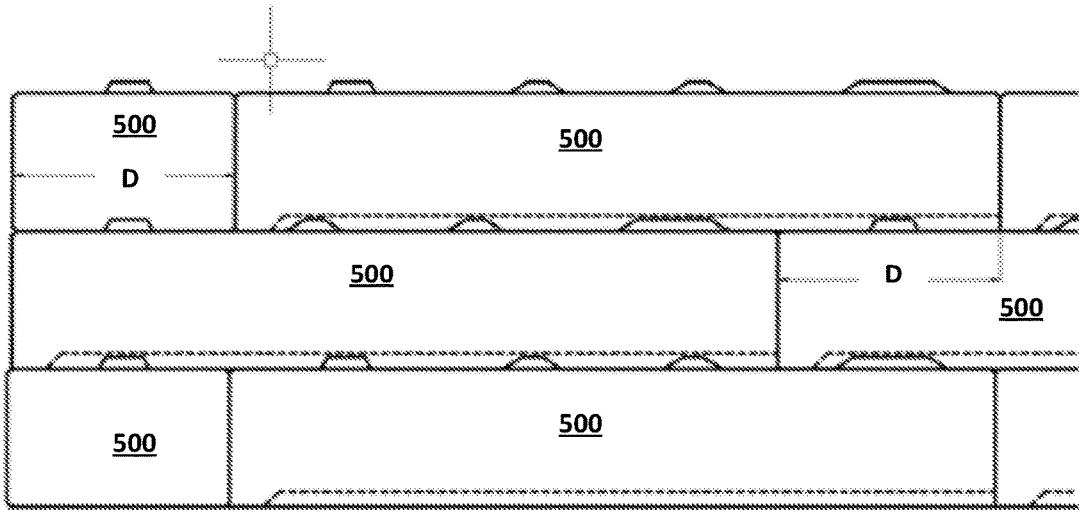
FIG. 16 is a front elevation view of the interaction between several of the retaining wall blocks according to an embodiment in three successive courses of a retaining wall having a natural bond pattern.
Figure 17:
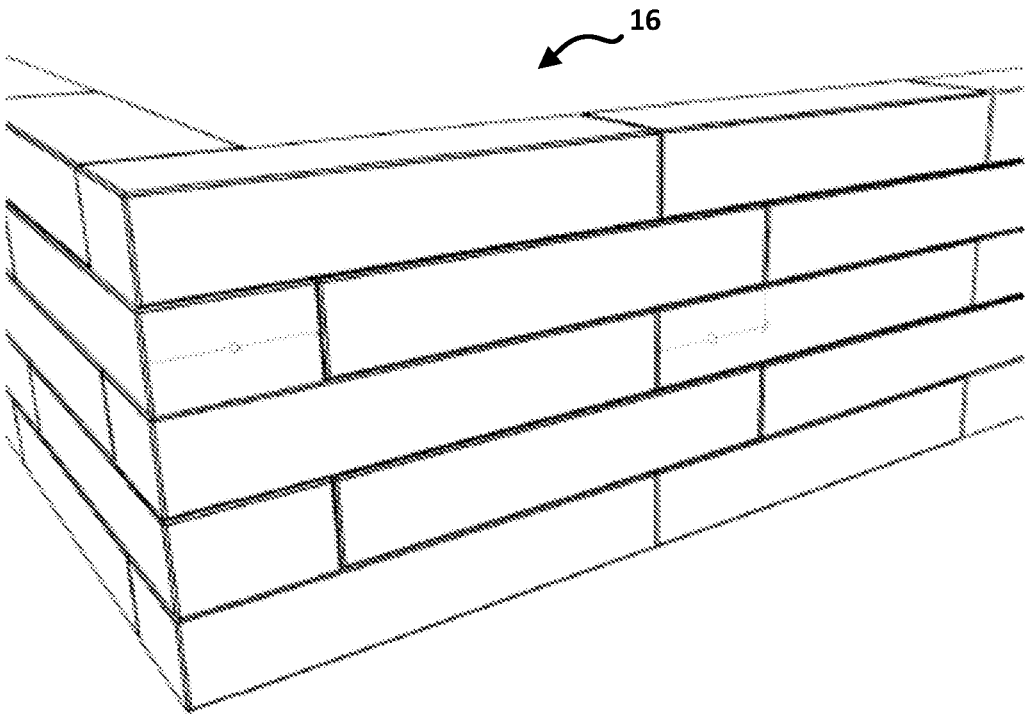
FIG. 17 is a perspective view of a corner of a retaining wall having a natural bond pattern made with retaining wall blocks of FIG. 12, according to an embodiment.
Figure 18:
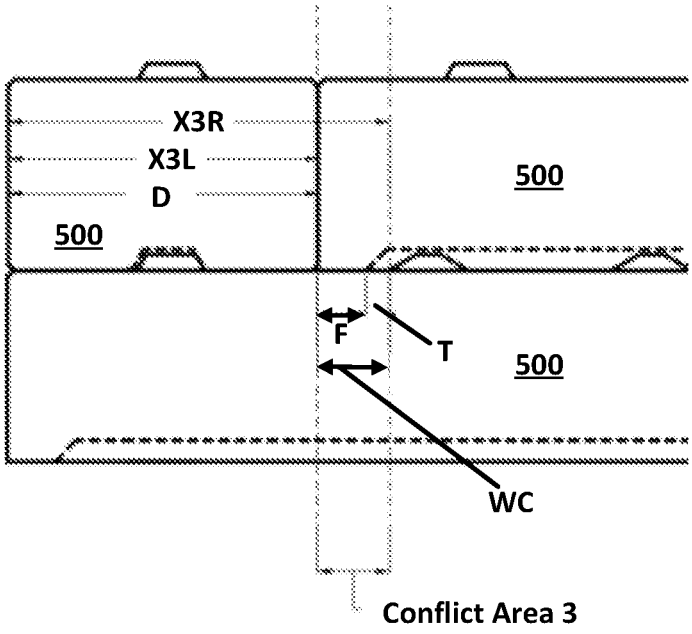
FIG. 18 is a front elevation view of a corner portion of the retaining wall of FIG. 17, showing in section two successive courses of retaining wall blocks according to an embodiment and showing a third conflict area.

FIG. 16 is a front elevation view of the interaction between several of retaining wall blocks 500 according to an embodiment in three successive courses of a retaining wall having a natural bond pattern. FIG. 17 is a perspective view of a corner of a retaining wall 16 having a natural bond pattern made with retaining wall blocks 500, according to an embodiment, and FIG. 18 is a front elevation view of a corner portion of the retaining wall of FIG. 17, showing in section two successive courses of retaining wall blocks 500 and a third conflict area.

In this instance, a left extent X3L of this third conflict area is shown in Equation 5, below:

$$X3L=D \quad (5)$$

Similarly, a right extent X3R of the third conflict area is shown in Equation 6, below:

$$X3R=D+WC \quad (6)$$

Fourth and fifth conflict areas arise at the corner. In this area, it is not the "Filled Portion" of groove 582 that is in conflict. Rather, when constructing a 90-degree Corner, units are stacked perpendicular (at a 90 degree offset) to each other on alternating courses. As such, it is the portions of block 500 in front of and behind groove 582 that could be in conflict with a male component 590 of the block 500 below, if not for accommodations made for these corresponding fourth and fifth conflict areas.

Figure 19:
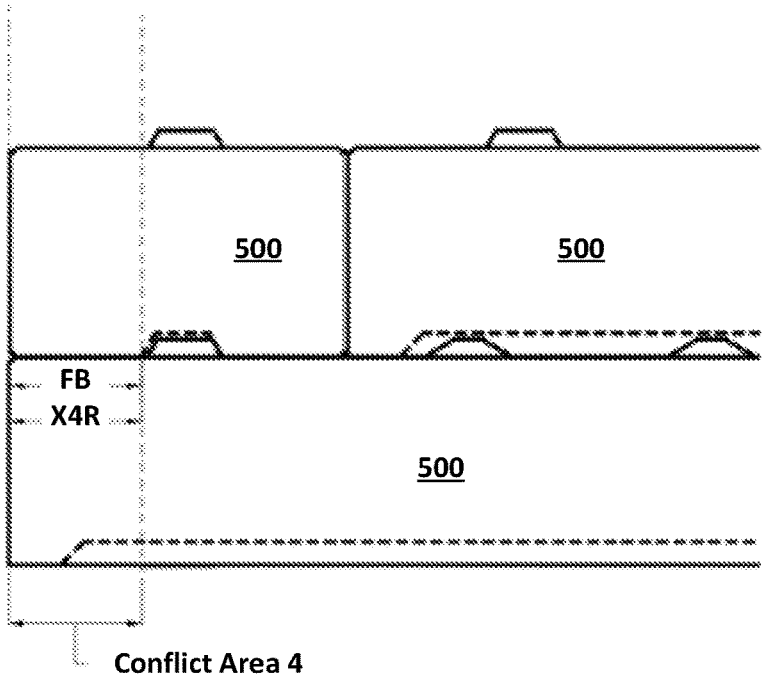
FIG. 19 is a front elevation view of a corner portion of the retaining wall of FIG. 17, showing in section two successive courses of retaining wall blocks according to an embodiment and showing a fourth conflict area.

Regarding the fourth conflict area, as described above, FB corresponds to the depth between front 530 of block 500 and groove 582 in bottom 520 of block 500. FIG. 19 is a front elevation view of a corner portion of the retaining wall of FIG. 17, showing in section two successive courses of retaining wall blocks 500 according to an embodiment and showing the fourth conflict area.

The left extent X4L of the fourth conflict area is zero (0), as this corresponds to front 530 of the uppermost block 500 and first side 560 of the lowermost block 500, as shown in Equation 7, below:

$$X4L=0 \quad (7)$$

Due to the depth FB between front 530 and groove 582, the right extent X4R of the fourth conflict area is shown in Equation 8, below:

$$X4R=FB \quad (8)$$

Figure 20:
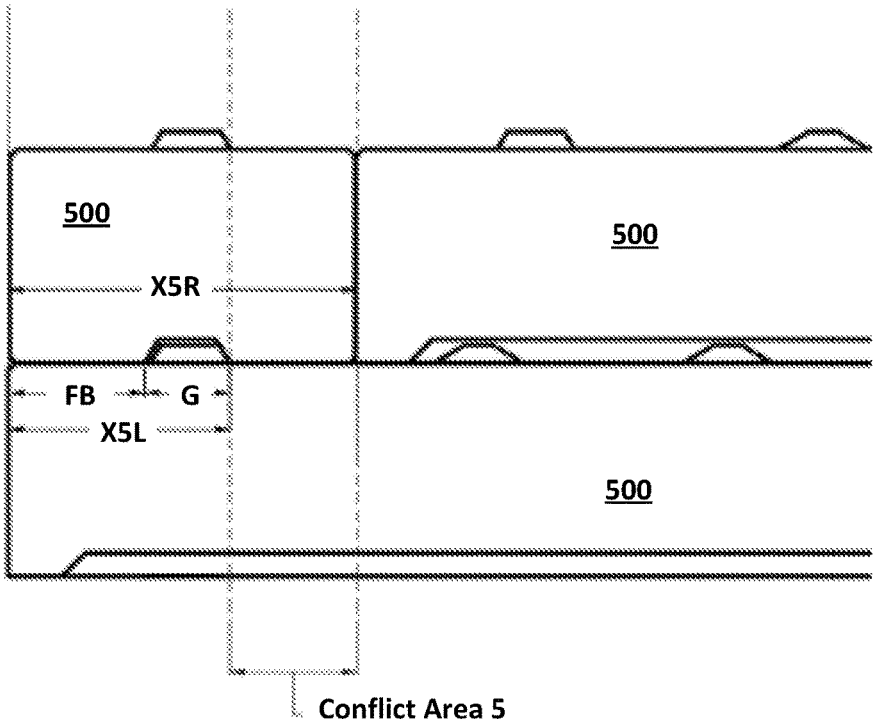
FIG. 20 is a front elevation view of a corner portion of the retaining wall of FIG. 17, showing in section two successive courses of retaining wall blocks according to an embodiment and showing a fifth conflict area.

The area extending past groove 582 in block 500 to rear 540 is the fifth conflict area. FIG. 20 is a front elevation view of a corner portion of the retaining wall of FIG. 17, showing in section two successive courses of retaining wall blocks 500 and showing the fifth conflict area. As the depth of groove 582 is depth G, the left extent X5L of the fifth conflict area is shown in Equation 9, below:

$$X5L=FB+G \quad (9)$$

Similarly, because the right extent X5R of the fifth conflict area ends at D, the right extent X5R is shown in Equation 10, below:

$$X5R=D \quad (10)$$

Figure 21:
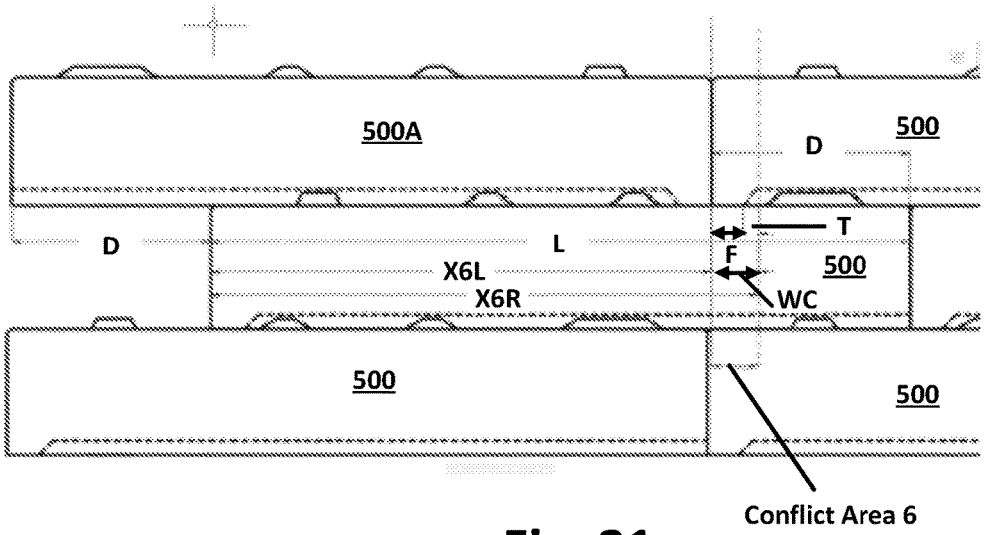
FIG. 21 is a front elevation view of a middle portion of the retaining wall of FIG. 17, showing in section two successive courses of retaining wall blocks according to an embodiment and showing a sixth conflict area.

FIG. 21 is a front elevation view of a middle portion of the retaining wall of FIG. 17, showing in section two successive courses of retaining wall blocks 500 and showing a sixth conflict area. In this embodiment, for a natural bond pattern as described above using the 90 degree oriented block, a sixth conflict area arises at the right side of block 500 where an overlap of extent D (the depth of block 500) occurs.

The left extent X6L of this sixth conflict area is shown in Equation 11, below:

$$X6L=L-D \quad (11)$$

Similarly, the right extent of this sixth conflict area is shown in Equation 12, below:

$$X6R=X6L+WC \quad (12)$$

Figure 22:
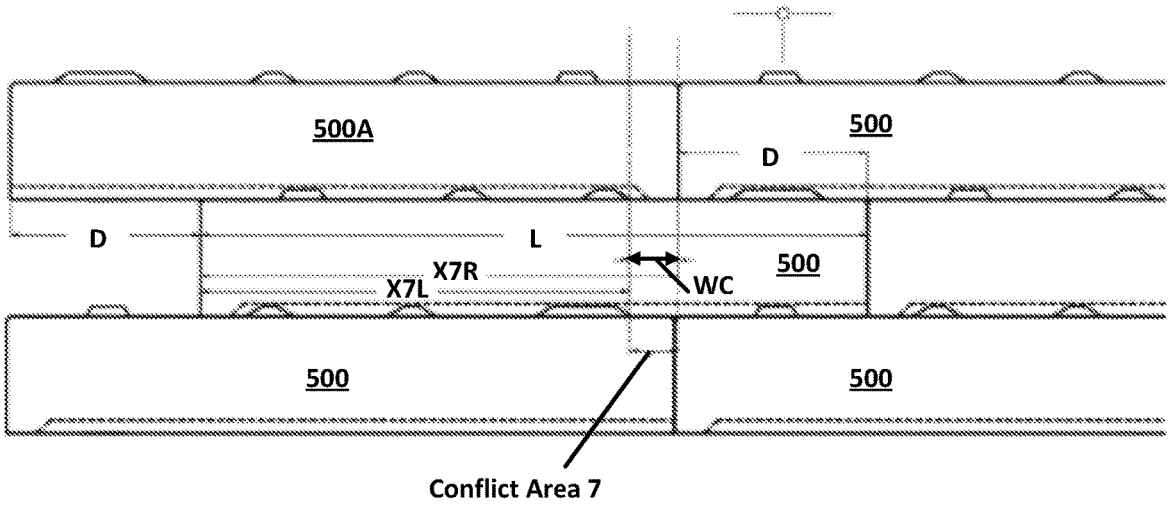
FIG. 22 is a front elevation view of a middle portion of the retaining wall of FIG. 17, showing in section two successive courses of retaining wall blocks according to an embodiment and showing a seventh conflict area.

In a similar manner to the half bond pattern, with natural bond two "Filled portions" on the same course may be adjacent to each other. For example, in a typical mold arrangement, the mold would be configured such that half of the blocks in the mold would be for left corners (as in block 500) where the closed end would be on the left side of the block and half would be for right corners (as in block 500A) where the closed end would be on the right side of the block. Were these two variations of blocks to be placed within a retaining wall as standard course blocks in a natural bond construction, the situation would arise where a left corner block 500 would be placed adjacent to a right corner block 500A. In this case, the "Filled portion" within groove 582 for block 500 would be on the left side of one block and the "Filled portion" within groove 582 for block 500A would be on the right side of one adjacent block. As such, there would be two adjacent "Filled Portions" within the retaining wall in a natural bond construction. A seventh conflict area thus arises. FIG. 22 is a front elevation view of a middle portion of the retaining wall of FIG. 17, showing in section two successive courses of retaining wall blocks and showing the seventh conflict area.

In this embodiment, the right extent X7R is shown in Equation 13, below:

$$X7R=L-D \quad (13)$$

Similarly, the left extent X7L is shown in Equation 14, below:

$$X7L=X7R+WC \quad (14)$$

As would be understood, by the identification of seven conflict areas that would arise as a result of the Filled Portion and the portions of block 500 that are in front of and behind groove 582, with the required orientations for corner construction, the flexibility required for half-bond and natural bond construction, and the flexibility required for interfacing adjacent left corner and right corner blocks, certain sizing required for certain gaps G1 through G5 in male component 590 of the vertical interlock interface, and certain sizing required for certain male keys K1 through K4, can be derived as described herein. It will be understood that, to an extent, the conflict areas define the minimum lengths of the gaps, where gaps may be slightly larger provided that all gaps and all keys in combination do not exceed the length L of block 500. It will also be understood that, in the discussion herein regarding conflict areas, the potential conflict areas were defined in connection with overlying blocks without features that account for batter. As such, where batter is required to be available, male key K1 would begin at just slightly greater than FB an amount J, and the corresponding gap spacings and male key sizings would extend along block 500 in relation to the gap length of the first gap G1 being at least FB+J.

Figure 23:
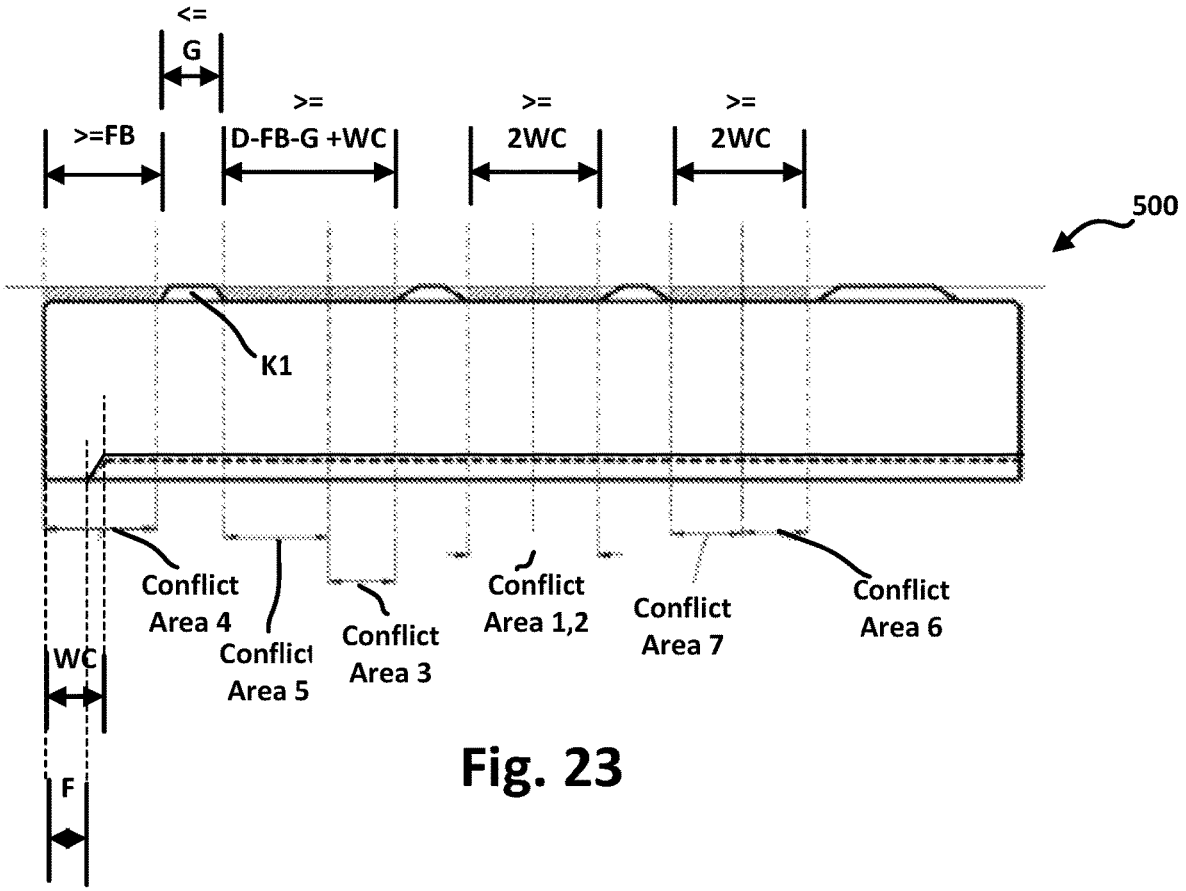
FIG. 23 is a front elevation view of the retaining wall block of FIG. 12, showing first through seventh conflict areas together in one view.

FIG. 23 is a front elevation view of retaining wall block 500, showing first through seventh conflict areas together in one view, along with the corresponding required gap spacing minimums and, in the case of first male key K1, first male key length limit.

Additional embodiments are possible.

For example, while in embodiments described above male component 590 is spaced from front 530 by a distance of FB+J to provide batter, embodiments are contemplated in which the spacing of male component 590 from front 530 corresponds to the spacing of female component 580 from front 530, thereby to provide no batter between successive courses. That is, for J=0. In such embodiments, then, first gap G1 would require a first gap length of only at least FB, and the gap length in such an embodiment could in principal be less than FB+J in the embodiments described above but still more than FB alone.

Furthermore, while in embodiments described above third gap G3 is centred at the halfway point—that is, at L/2—along block body 505, in an alternative embodiment, third male key K3 can be provided with a different length than second male key K2, while satisfying the other constraints. That is, K2 and K3 may not only each be shorter in length than depicted in the figures (provided the structural integrity is maintained), but may be of different lengths. In the case where K2 and K3 are of different lengths, third gap G3 would not be centred at L/2 but would be centred just to the right or to the left of L/2 accordingly. This would not preclude the placement and interlocking of successive courses of blocks 500 as described herein.

Figure 24:
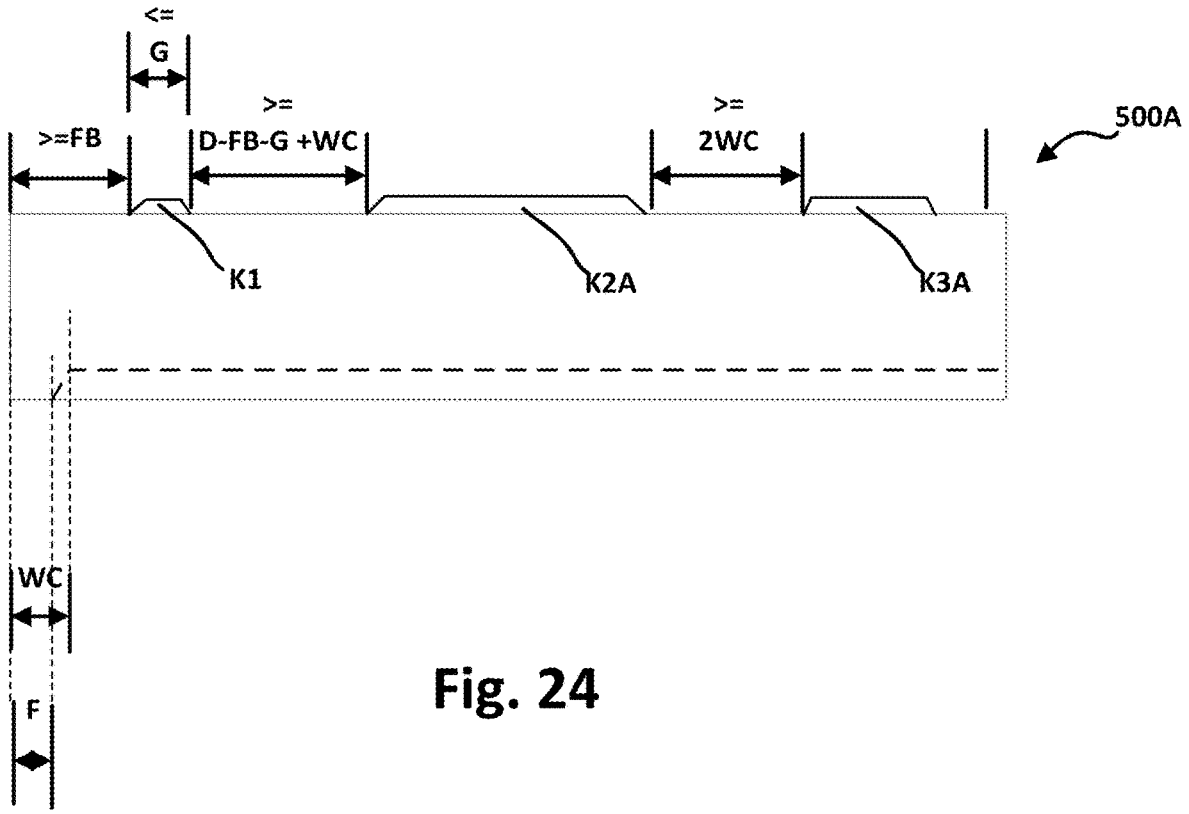
FIG. 24 is a front elevation view of an alternative retaining wall block.

Furthermore, while embodiments of retaining wall block described herein are capable of being used either in natural bond or half bond patterns, alternatives are contemplated in which a retaining wall block with finished corners is usable only in natural bond pattern and not in a half bond pattern. As will be appreciated upon review of the above description, if only natural bond patterns are required to be accommodated, then only conflict areas arising from positioning of blocks in natural bond pattern need to be accounted for. As such, conflict areas 1 and 2 would not need to be accounted for. Therefore, in an alternative block that is suitable only for natural bond, the third gap as shown herein is not required, provided that the fourth gap begins no closer to the second side than D+F and extends a length of at least 2F but not all the way to the second side thereby to provide at least a male key between such a fourth gap and the second side. Put another way, second male key and third male key may be undivided by any third gap, or there may be a third gap that does not correspond to a gap suitable for accommodating half bond pattern placements. An example of such an alternative block 500A is shown in FIG. 24. As is shown in this figure, the first gap is at least FB, the first male key K1 is no larger than G, the second gap is at least D−FB−G+WC and extends at least as far as D+WC from left side 560. In this embodiment, the second male key K2A is centred on the block 500A and extends no farther than L−D−WC from first side 560. The third gap is at least 2WC and extends to a third male key K3A which is positioned and sized as in block 500 described above and alternatives thereof.

What is claimed is:

1. A retaining wall block comprising:
- a block body having:
  - a top and a bottom spaced from the top by a height H;
  - a front and a rear spaced from the front by a depth D; and
  - a first side and a second side spaced from the first side by a length L;
- a vertical interlock system comprising:
  - a female component comprising a groove in the bottom of the block body, the groove being spaced from the front by a depth FB and having a depth G, the groove extending from a distance F from the first side through to the second side, wherein F<FB and FB+G<D; and
  - a male component extending across the top of the block body between the first side and the second side, the male component being spaced from the front by at least a depth of FB and having a depth no greater than G, wherein a plurality of gaps in the male component comprise:
    - a first gap extending from the first side and having a first gap length of at least FB;
    - a second gap spaced from the first gap by no more than G and having a second gap length of at least D−FB−G+F, the second gap extending at least to D+F from the first side;
    - a third gap spaced from the second gap and having a third gap length of at least 2F; and
    - a fourth gap spaced from the third gap and having a fourth gap length of at least 2F, the fourth gap extending at least to L−D+F from the first side wherein the fourth gap does not extend all the way to the second side.

2. The retaining wall block of claim 1, wherein:
- the male component is spaced from the front by a depth of FB; and
- the first gap length is FB.

3. The retaining wall block of claim 1, wherein:
- the male component is spaced from the front by a depth of FB+J, wherein J is a batter offset; and
- the first gap length is FB+J.

4. The retaining wall block of claim 1, wherein the second gap is spaced from the first gap by distance G.

5. The retaining wall block of claim 1, wherein the second gap is spaced from the first gap by less than G.

6. The retaining wall block of claim 1, further comprising:
- a fifth gap spaced from the fourth gap and extending all the way to the second side.

7. The retaining wall block of claim 1, wherein:
- the second gap length is at least D−FB−G+WC;
- the third gap length is at least 2 WC; and
- the fourth gap length is at least 2 WC,
- wherein WC=F+T and T is a tolerance.

8. The retaining wall block of claim 1, wherein the third gap is centred at L/2 along the block.

9. The retaining wall block of claim 1, wherein each of the groove and the male component is bevelled.

10. A set of retaining wall blocks comprising:
- a first plurality of retaining wall blocks according to claim 3, wherein the first side is the left side; and
- a second plurality of retaining wall blocks according to claim 3, wherein the first side is the right side.

11. A retaining wall block comprising:
- a block body having:

a top and a bottom spaced from the top by a height H;

a front and a rear spaced from the front by a depth D; and a first side and a second side spaced from the first side by a length L;

a vertical interlock system comprising:

a female component comprising a groove in the bottom of the block body, the groove being spaced from the front by a depth FB and having a depth G, the groove extending from a distance F from the first side through to the second side, wherein F<FB and FB+G<D; and a male component extending across the top of the block body between the first side and the second side, the male component being spaced from the front by at least a depth of FB and having a depth no greater than G, wherein the male component comprises:

a first male key spaced from the first side by a first gap having a first gap length of at least FB, the first male key having a first male key length of no greater than G;

a second male key spaced from the first male key by a second gap having a second gap length of at least D−FB−G+F, the second gap extending at least to D+F from the first side;

a third male key spaced from the second male key by a third gap having a third gap length of at least 2F; and a fourth male key spaced from the third male key by a fourth gap having a fourth gap length of at least 2F, the fourth gap extending at least to L−D+F from the first side.

12. The retaining wall block of claim 11, wherein:

the male component is spaced from the front by a depth of FB; and the first gap length is FB.

13. The retaining wall block of claim 11, wherein:

the male component is spaced from the front by a depth of FB+J, wherein J is a batter offset; and the first gap length is FB+J.

14. The retaining wall block of claim 11, wherein the first male key length is G.

15. The retaining wall block of claim 11, wherein the first male key length is less than G.

16. The retaining wall block of claim 11, wherein the fourth male key does not extend all the way to the second side.

17. The retaining wall block of claim 11, wherein:

the second gap length is at least D−FB−G+WC;

the third gap length is at least 2 WC; and the fourth gap length is at least 2 WC, wherein WC=F+T and T is a tolerance.

18. The retaining wall block of claim 11, wherein the third gap is centred at L/2 along the block.

19. The retaining wall block of claim 11, wherein each of the groove and the male component is bevelled.

20. A set of retaining wall blocks comprising:

a first plurality of retaining wall blocks according to claim 13, wherein the first side is the left side; and a second plurality of retaining wall blocks according to claim 13, wherein the first side is the right side.

* * * * *